United States Patent [19]

Eickmann

[11] 3,951,044

[45] Apr. 20, 1976

[54] ROTARY RADIAL PISTON MACHINES WITH FLUIDFLOW SUPPLY IN SUBSTANTIAL AXIAL DIRECTION

[76] Inventor: Karl Eickmann, 2420 Isshiki, Hayama, Kanagawa, Japan

[22] Filed: Jan. 13, 1970

[21] Appl. No.: 2,624

Related U.S. Application Data

[63] Continuation-in-part of Ser. No. 749,028, July 31, 1968, abandoned, which is a continuation-in-part of Ser. No. 461,483, June 4, 1965, Pat. No. 3,398,698.

[30] Foreign Application Priority Data

| | | |
|---|---|---|
| June 11, 1964 | Switzerland | 7664/64 |
| June 11, 1964 | Switzerland | 7665/64 |
| July 10, 1964 | Switzerland | 9137/64 |

[52] U.S. Cl. ..... 91/485

[51] Int. Cl.[2] ..... F01B 13/06

[58] Field of Search ..... 417/217; 91/484, 485, 91/491

[56] References Cited

UNITED STATES PATENTS

| | | | |
|---|---|---|---|
| 2,381,741 | 8/1945 | Grosser | 91/484 |
| 2,458,985 | 1/1949 | Ferris et al. | 91/497 |
| 2,716,944 | 9/1955 | Ferris | 91/497 |
| 2,728,302 | 12/1955 | Ferris | 91/492 |
| 2,895,426 | 7/1959 | Orshansky | 91/485 |
| 2,972,961 | 2/1961 | Clark | 91/485 |
| 3,066,613 | 12/1962 | Reinke | 91/485 |
| 3,086,477 | 4/1963 | Kuhl | 91/487 |
| 3,090,361 | 5/1963 | Orshansky, Jr. | 91/485 |
| 3,092,036 | 6/1963 | Creighton | 91/485 |
| 3,122,971 | 3/1964 | Russell | 91/491 |
| 3,136,263 | 6/1964 | Timms | 91/491 |
| 3,257,959 | 6/1966 | Budzich | 417/217 |
| 3,295,459 | 1/1967 | Griffith | 91/488 |
| 3,435,775 | 1/1969 | Parrett | 91/485 |

FOREIGN PATENTS OR APPLICATIONS

| | | | |
|---|---|---|---|
| 897,700 | 5/1962 | United Kingdom | 91/485 |

*Primary Examiner*—William L. Freeh
*Attorney, Agent, or Firm*—Michael S. Striker

[57] ABSTRACT

In a rotary radial piston machine substantially axially extending passages are provided extending from the respective cylinders in axial direction through the rotor for directing the flow of fluid into and out of the rotor. A control body has entrance and exit passages and is located at least at one end of the rotor, and means are provided for obtaining a suitable clearance between a rotary control face of the rotor and a stationary control face of the stationary control body preferably including annular balancing chambers whose pressures act in axial direction on a sleeve guided on the rotor shaft and having an end abutting the control body.

2 Claims, 7 Drawing Figures

INVENTOR.

BY KARL EICKMANN

Robert Mohr
Atty

INVENTOR.

BY KARL EICKMANN

INVENTOR.
KARL EICKMANN

BY
[illegible]
Attorney

INVENTOR.
KARL EICKMANN

BY

ROTARY RADIAL PISTON MACHINES WITH FLUIDFLOW SUPPLY IN SUBSTANTIAL AXIAL DIRECTION

CROSS-REFERENCES TO RELATED APPLICATIONS

The present application is a continuation-in-part of my copending patent application Ser. No. 749,028 filed on July 31, 1968, now abandoned which is a continuation-in-part of my earlier patent application Ser. No. 461,483 filed on June 4, 1965 now U.S. Pat. No. 3,398,698.

BACKGROUND OF THE INVENTION

The present invention is concerned with the construction of rotary radial piston machines which are suitable for operation as compressors, pumps, combustion engines, air motors, gas motors, hydraulic pumps, hydraulic motors or the like.

Machines of this type are supplied with fluid in axial direction through a stationary body containing ports. The problem exists that the force at which the rotary control face of the rotor and the stationary control face of a stationary part are pressed together, should have a predetermined value. Furthermore, one of the adjacent control faces should be axially movable and also universally movable to a limited extent to prevent jamming and sticking of the control faces to each other.

SUMMARY OF THE INVENTION

It is an important object of the invention to provide means to control the axial flow of fluid into and out of the rotor in radial piston machines so that the respective stationary and rotating control faces are pressed against each other at a correctly determined force so that excessive wear, tilting, leakage, and friction are avoided as far as possible, or at least substantially reduced.

With these objects in view, the invention is concerned with machines in which all moving parts are guided in such a manner that all pressure is concentrated on cooperating control faces which prevents binding of parts which move relative to each other.

The present invention will be best understood with reference to the accompanying drawing.

DESCRIPTION OF THE PREFERRED EMBODIMENTS

Figure 1:
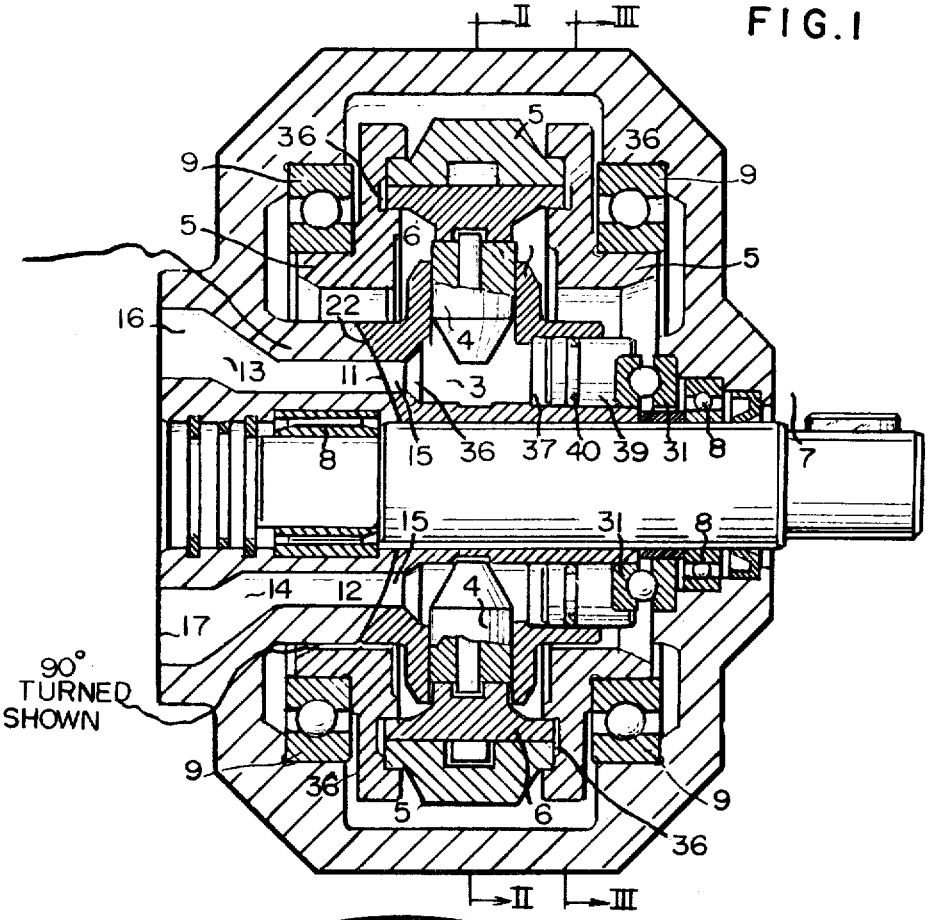
FIG. 1 is an axial sectional view of an embodiment of the invention.
Figure 2:
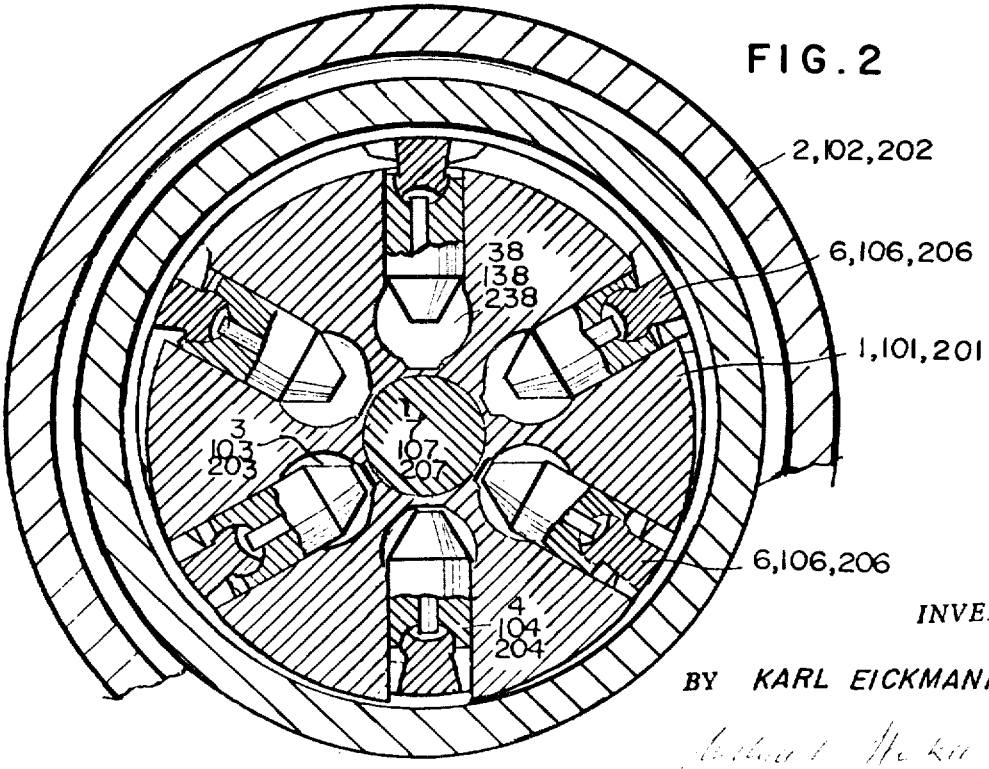
FIG. 2 is a cross-sectional view taken on line II—II in FIG. 1.
Figure 3:
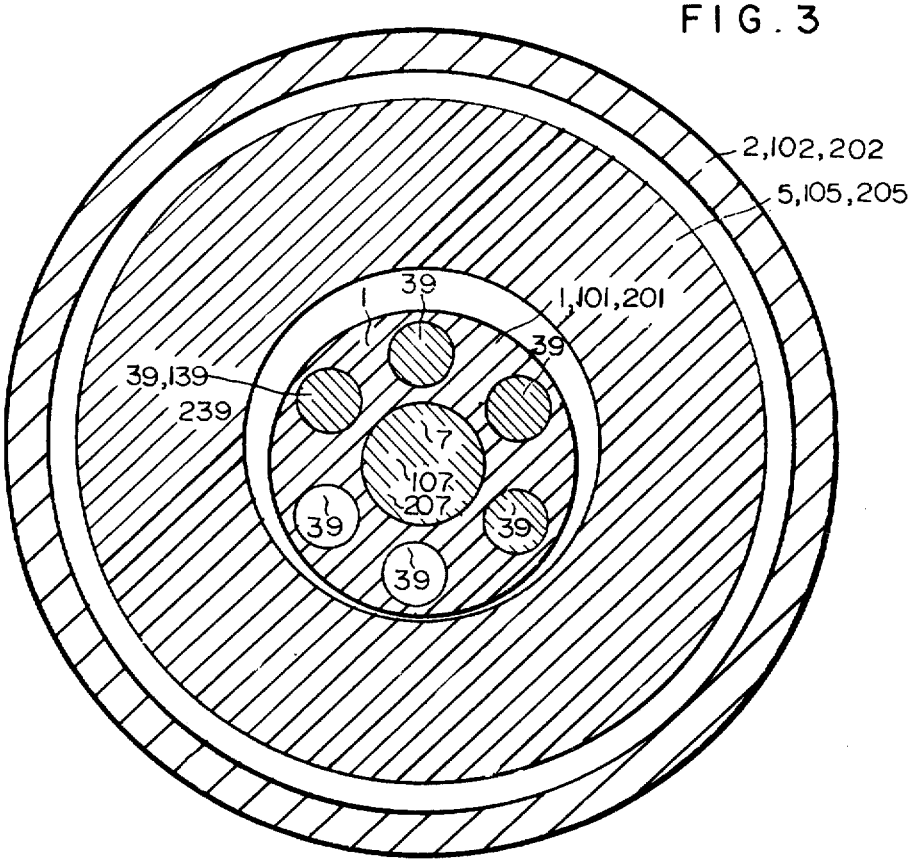
FIG. 3 is a cross-sectional view taken on line III—III in FIG. 1.

Referring first to FIGS. 1-3, a rotor 1 is mounted in a casing 2 and has radial working chambers 3, pistons 4 in the working chambers, an actuator ring 5, a piston shoe 6, a shaft 7, rotor bearings 8, actuator bearings 9, axial or thrust bearings 31, and a clearance 36 at the axial ends of the piston shoes 6. Fluid passages 13 and 14 have ports 16 and 17 and control ports 11 and 12. The stationary body portion 2a of casing 2, has a stationary control face 22 which cooperates which the rotor control face. Each working chamber 3 in rotor 1 has a balancing chamber 37 closed by a cover 39 which is supported on bearing means 31 mounted in casing 2. Cover means 39 may be provided with sealing means 40 for sealing the fluid-containing balancing chamber 37 at its axial outward end. The cross-section through balancing chamber 37 is dimensioned so large that the pressure which acts out of balancing chamber 37 in axial direction against the control body is higher than the opposite fluid pressure acting on rotor 1. It is therefore important that the cross-section through the balancing chamber 37 is larger in dimensions than the cross-section through passage 15 which is connected with the same working chamber 3. For manufacturing purposes, it is best to provide a rotor passage 15 having a certain diameter, and to make a medial bore of greater diameter than rotor passage 15, while the balancing chamber 37 has a still bigger diameter. Cover means 39 may be constructed to abut with its outer end against a rotary part of the thrust bearing 31, and may have such a shape that it cannot rotate about its own axis because such rotary movement is prevented by an extension of cover means 39 which is engaged by the rotary part of bearing 31.

In dimensioning the cross-section of the fluid-containing balancing chamber 37 it is necessary to take into consideration the fluid pressure which acts out of the respective control ports 11 or 12 against rotor 1 in the opposite axial direction. The number of fluid-containing balancing chambers 37, which are filled with pressure fluid out of control port 11, must altogether have such a large cross-sectional area that the pressure thereof is greater than the pressure out of control port 11 against rotor 1. The same applies also to the control port 12 and the balancing chambers 37 connected therewith during operation of the machine and rotation of rotor 1.

The stationary control face 22 is shown to be spherical and to cooperate with the corresponding spherical control face of the rotor. Shaft 7 is supported in bearing 8, and rotor 1 is supported by shaft 7 and connected therewith by key means, not shown.

It is characteristic of the embodiment of FIG. 1 that balancing chambers 37 are supplied with high pressure only when they communicate with the respective high pressure control port, while balancing chambers 37 which are communicating with a respective low pressure control port 11 or 12 contain pressure fluid at the respective low pressure. During the movement of working cylinders 3 over the points where the pistons 4 are in the outermost or innermost positions, a corresponding expansion or compression takes place in working cylinder 3 and the rotor passage connected therewith, and also in the respective balancing chamber 37, if the respective passages are closed by the closing portion of the stationary control face 22. Therefore, during an increase of the pressure in the rotor passage 15 and working cylinder 3, a corresponding increase of pressure takes place also in the corresponding balancing chamber 37.

In this manner, rotor 1 is always pressed against a stationary control body portion 2*a* of casing 2.

Another feature of the embodiment of FIG. 1 is that leakage and friction is prevented so that the machine operates at high efficiency. A separate balancing chamber 39 cooperates with each working cylinder 3 and rotor port 15, and control ports 11 or 12, and is immediately responsive.

As shown in FIG. 1, there are clearance spaces 36 provided at the axial ends of the piston shoes 6. Clearance spaces 36 extend into the actuator ring 5 in order to make it possible that piston shoes 6 move in axial direction to a limited extent if the rotor performs small axial movements. Limited axial movements of rotor 1 occur and are necessary because after prolonged use of the apparatus, the control faces are worn, so that the control faces gradually abut each other more closely which results in a small movement of rotor 1 toward the stationary control body portion and stationary control face 22. The pressure of the balancing chambers 37 varies dependent on the pressure in the machine, and therefore changes in the dimensions of the rotor due to deformation taking place which are different depending on the material of the rotor, and consequently the rotor moves very small distances in axial direction. If no free clearance spaces 36 would be provided at the axial ends of the piston shoes 6, then a piston shoe 6 may bear against or stick to the respective surface portion of the actuator ring 5. The clearance spaces 36 have such a radial and axial extension that piston shoes 6 can freely move corresponding to the movements of rotor 1.

Rotor 1 is retained on shaft 7 which is rotatably supported in bearings 9 in housing 2. Pistons 4 and piston shoes 6 are actuated by the actuator ring means 5 to move inward and outward in radial direction. Fluid from inlet port 16 flowing through inlet passage 13 and control port 11, and then through the respective rotor passages 15 into working cylinders 3, flows from there through the rotor passages 15 into control port 12 and from there through passage 14 to the outlet port 17. In order to reduce the manufacturing costs, rotor passages 15 are cast together with bores 38 and the balancing chambers 37. These chambers and passages can also be pressed into a suitable material such as bronze or synthetic plastic material. Rotor passages 15, spaces 38, and balancing chamber 37 can also be automatically machined by boring machines. If rotor passage 15, chamber 38 and working chamber 3 are cylindrical, then they can be easily automatically machined to high precision and in an inexpensive manner. If the rotor passages 15 are non-cylindrical, they can be produced by milling cutters, or presses, because passages 15 are short and located at the axial end of the rotor.

Another feature of the embodiment is to make the space 38 enlarged in peripheral direction so that it is wider than the respective cylinder chamber 3, and has a greater diameter than the same. The advantage is that working chamber 3 can be easily machined by drilling machine, because the drill can be moved inward into the space 38 so that no sharp burrs remain, and the working cylinder 3 can be made as a straight bore of uniform diameter throughout its entire length, having intersecting recesses at the radially inner end of working cylinder 3 so that the machining tools can freely move into the intersecting grooves or recesses provided by the space 38.

FIGS. 2 and 3 are cross-sectional views of the embodiment of FIG. 1 and show clearly the position of the several parts. FIG. 2 clearly shows that the spaces 38 are wider in circumferential direction than the respective bores of cylinder chambers 3. FIG. 3 shows the eccentricity of the axis of rotor 1 in relation to the actuator ring 5. FIG. 3 also shows the balancing chambers 38 covered by covers 39, separately provided for each working cylinder 3.

In the embodiment of FIGS. 1–3, the axial thrust produced by the fluid between the control face 22 and the corresponding control face of rotor 1, is balanced by the pressure in the balancing chambers 37 which are closed by individual covers 39 abutting the thrust bearings 31 so that the width of the clearance between the control spaces of the body portion **2*a* of housing 2** and the rotor control face is exactly determined.

Figure 4:
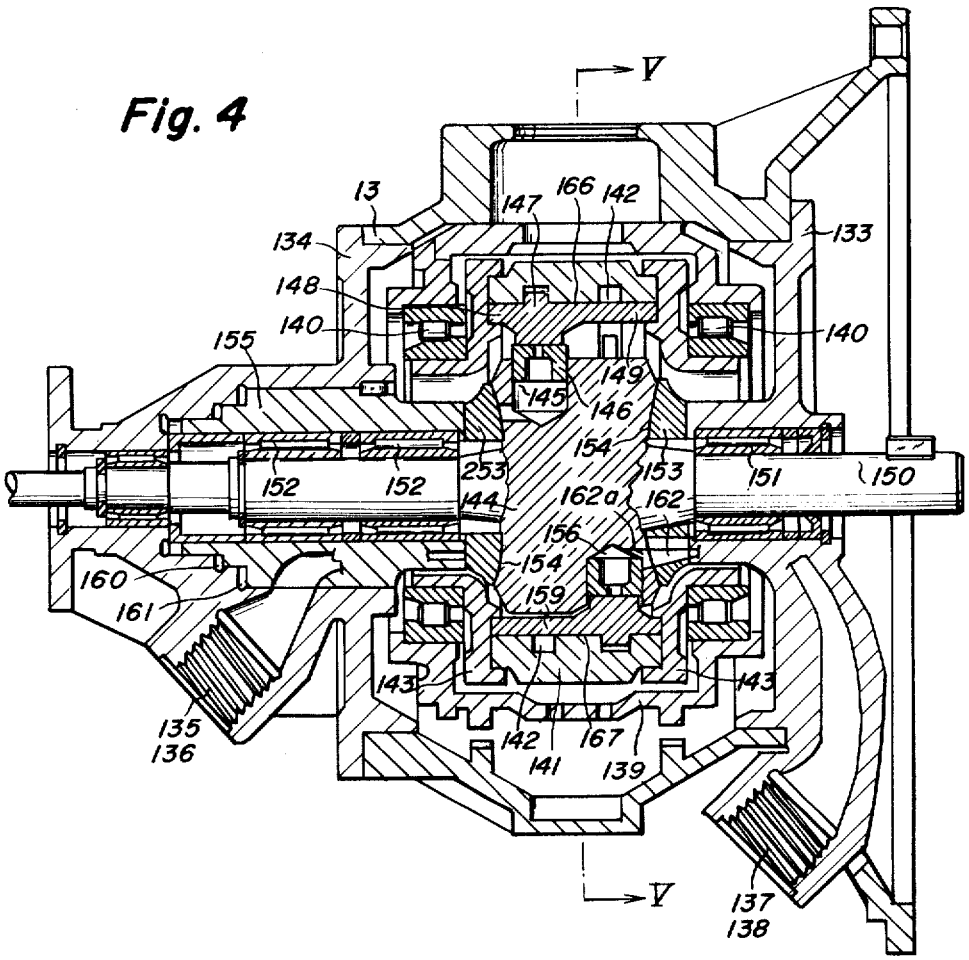
FIG. 4 is an axial sectional view illustrating another embodiment of the invention.
Figure 5:
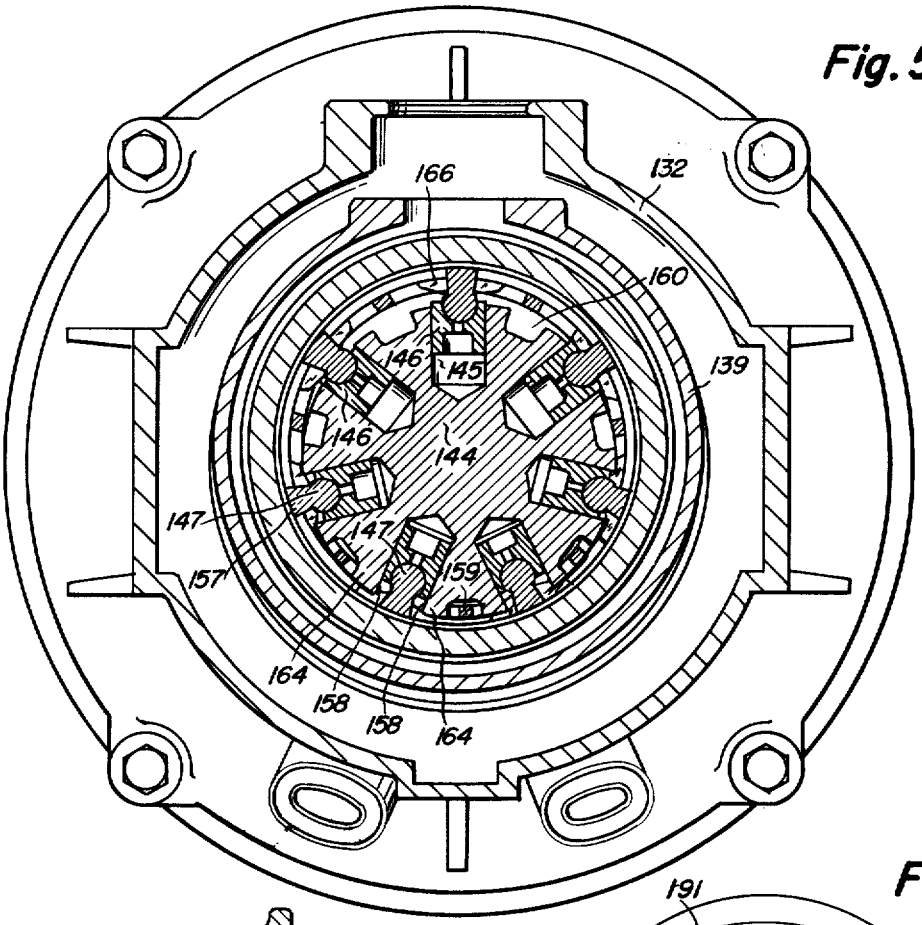
FIG. 5 is a cross-sectional view taken on line V—V in FIG. 4.

Referring now to the embodiment illustrated in FIGS. 4 and 5, the pressure is also concentrated on control faces. A heavy mass is concentrated on a shaft which is directly or indirectly coupled with the rotor of the machine. This mass, revolving with the shaft, forms an energy storage similar to a flywheel, and the kinetic energy present in the rotating mass during rotation of the shaft at high rotary speed may be ten to hundred times greater than the normal power of the pump, so that it is possible to rapidly release a part of the stored energy of the energy-storing mass, and to transfer such energy to the pump within fractions of a second, such as 1/100 of a second, so that part of the kinetic energy stored in the mass is transformed into flow energy of the fluid in the machine so that the volume of fluid delivered by the pump is rapidly increased.

In accordance with tests carried out with the pump according to the invention, the time for adjusting the pump from no delivery of fluid to maximum delivery was only about 0.01 seconds. Referring to FIGS. 4 and 5, displacement means including piston 146 and piston shoes 147 are located in the working chambers or cylinders 145 of the rotor. Displacement actuator means 166, 167, 142, 143, 149, and 140 control the radial piston movement into working cylinders 145. A shaft 150 is mounted in the housing at the center of the rotor 144, and bearings 151 and 152 support shaft 150. Control bodies 153 and 253 are provided at opposite axial ends of the rotor 144 which have center parts with ball-shaped stationary control faces 154 confronting each other and corresponding rotary control faces of rotor 144. In this arrangement the rotor passage **162*a* which communicates with the working cylinders 145, or 156 are very short so that dead spaces are avoided and losses caused by internal compression are reduced. On the radially outward sides of the control bodies 153, 253 the respective end faces are planar, and extend perpendicularly to the rotor axis in radial direction, abutting on corresponding abutment faces of bearing bodies 133, 155. Control ports 162 are provided in the control bodies 153, 253 for the passage of fluid into and out of the working cylinders 145, 156 and form a bearing space in which cover body 155 is provided. Bearing body 133 is fixed and has an abutment face on which the planar rear face of control body 153 abuts. The bearing body 155 is a long sleeve and has an abutment face against which the planar rear face of control body 253 abuts. Bearing body 155 is mounted on the rotor shaft 150 in the space within cover 134 for guided axial movement to a limited extent. Rearward of the bearing body 155 there are two annular chambers 160, 161 which are separated and sealed from each other so that there is no communication between the chambers 160 and 161. Annular chambers 160, 161 are formed by stepped annular outer and inner shoulders or sleeve 155 and closure means 134, respectively which include sliding by engaged cylindrical surface portions sealing chamber 160, 161 from each other even during axial movement of sleeve 155. Communication passages, not shown, connect the chambers 160 and 161 with the inlet and outlet passages of the machine. The pressure in the chambers 160, 161 acts against the outer end of bearing body 155 and presses control body 155 in axial direction against rotor 144 so that sealing between the control faces is assured. Accordingly, it is necessary that the effective cross-sectional areas of the chambers 160, 161** are located and dimensioned to obtain the required pressure between the control faces.

It is preferred that both chambers 160 and 161 are annular, but eccentric to each other so that in a high pressure area, high pressure fluid acts on a greater area, and similar effects take place at the low pressure area. One of the chambers 160 is supplied with high pressure fluid, while the other chamber 161 is supplied with low pressure fluid.

Figure 6:
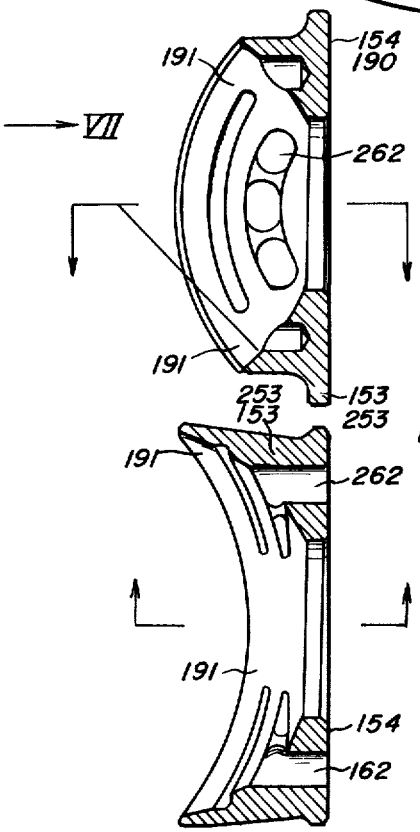
FIG. 6 includes two sectional views illustrating control bodies according to the invention.
Figure 7:
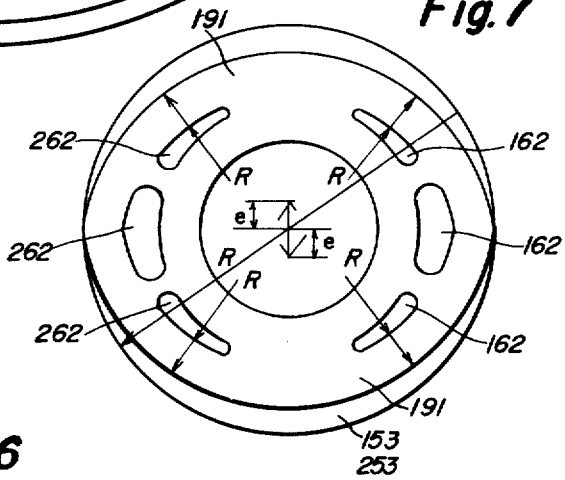
FIG. 7 is a side view taken in the direction of the arrow VII in FIG. 6.

FIGS. 6 and 7 show alternative embodiments of the control bodies 153 or 253. Contrary to the arrangement shown in FIG. 4 where the stationary control faces 154 are convex toward each other, the control body 153 or 253 shown in FIG. 6 has a planar control face 190 confronting the rotor. As a consequence of the cooperation of planar rotor and stator control faces, there are no radially acting forces, since all forces in this direction balance each other completely so that the control body is balanced in radial direction. Such radial balance is not assured for control bodies of conical or spherical shape. While the rear end face of control bodies 153, 253 in FIG. 4 is planar, the corresponding rear faces of the control body shown in FIG. 6 are spherical and outwardly concave, and require support on a correspondingly shaped abutment surface of a cover or other housing part. The concave rear face 191 of the control body 190 and the complementary abutment faces on respective housing cover and bearing portions, have a comparatively small radius corresponding to the outer diameter of the control body, so that control body 190 can perform small adjusting movements sliding on the complementary abutment face of the housing to a limited extent so that it is at the same time supported in radial and axial directions. Balancing recesses acting in radial and axial direction are preferably provided in the concave rear face 191 of the control body.

At least two fluid passage 162 are provided in the control body 153 and form ports in the same. If balancing chambers or fields for radial and axial balancing are provided, it is important that the balancing chambers are correctly dimensioned and substantially located opposite the chambers 160 and 161.

The invention is not intended to be limited to the details shown, since various modifications and structural changes may be made without departing from the scope of the present invention.

What is claimed as new and desired to be protected by Letters Patent is set forth in the appended claims.

I claim:

1. In a rotary fluid machine, in combination, a housing; rotor means including a shaft supported in said housing for rotation about a longitudinal rotor axis and a rotor having substantially radial working chambers; movable displacement means in said working chamber; actuator ring means actuating said displacement means in said working chambers for periodically increasing and decreasing the volume of the respective working chambers; a substantially stationary annular control body surrounding said shaft and having a stationary control face, said control body having entrance and exit passage means extending into control ports in said stationary control face of said control body; said rotor means being formed with a rotary control face on one axial end and having rotor passages extending each from said rotary control face of said rotor means into a cooperating working chamber in said rotor means; said rotary control face slidably abutting said stationary control face and forming therewith a small clearance preventing escape of large amounts of leakage; said housing including two bearing bodies surrounding said shaft and having axially inner annular end faces axially supporting said rotor on one side and abutting on the other side said control body, respectively, one of said bearing bodies being fixed and the other bearing body including an elongated sleeve mounting therein said shaft for limited axial movement, and having said inner annular end face at the axially inner end thereof, said bearing sleeve having at the axially outer end thereof a stepped annular outer shoulder surface; and closure means fixedly mounted on said housing and including a tubular portion surrounding and axially guiding said sleeve, and a stepped annular inner shoulder surface cooperating with said stepped annular outer shoulder surface to form at least two annular balancing chambers sealed from each other by slidingly engaged cylindrical surface portions of said inner and outer shoulder surfaces, and respectively containing high pressure fluid and low pressure fluid for urging said sleeve, guided by said tubular portion, in axial direction against said control body whereby said inner annular end face of said sleeve is perpendicular to said shaft and to said rotor axis when abutting said control body, whereby leakage between said stationary control face and the respective rotor control face is reduced.

2. In a rotary fluid machine, in combination, a housing; rotor means including a shaft supported in said housing for rotation about a longitudinal rotor axis and a rotor having a substantially radial working chambers; movable displacement means in said working chambers; actuator ring means actuating said displacement means in said working chambers for periodically increasing and decreasing the volume of the respective working chambers; passage means for passing fluid to and from said working chambers; two substantially stationary annular control bodies surrounding said shaft and each having inner and outer stationary control faces, each control body having entrance and exit passage means extending into control ports in said inner stationary control faces of said control bodies; said rotor means being formed with a rotary control face at each end and having rotor passages extending each from said control faces of said rotor means into a cooperating working chamber in said rotor; said rotary control faces slidingly abutting said inner stationary control faces, respectively, and forming therewith small clearances preventing escape of large amounts of leakage; said housing including two bearing bodies surrounding said shaft on opposite sides of said rotor and having axially inner annular end faces abutting said outer stationary control faces of said control bodies, one of said bearing bodies being fixed to the housing, and the other bearing body including an elongated sleeve mounting therein said shaft for limited axial movement, and having said inner annular end face at the axially inner end thereof, said bearing sleeve having a stepped annular outer shoulder surface at the axially outer end thereof; and closure means fixedly mounted on said housing and including a tubular portion surrounding and axially guiding said sleeve, and a stepped annular inner shoulder surface cooperating with said annular outer shoulder surface to form two annular balancing chambers sealed from each other by slidingly engaged cylindrical surface portions of said inner and outer shoulder surfaces, and respectively containing high pressure fluid and low pressure fluid for urging said sleeve, guided by said tubular portion, in axial direction against the respective control body whereby said inner annular end face of said sleeve is perpendicular to said shaft and to said rotor axis when abutting said outer stationary control face of the respective control body whereby said leakage between said inner stationary control faces and said rotor control faces is reduced.

* * * * *